United States Patent [19]

Stay

[11] Patent Number: 4,940,086

[45] Date of Patent: Jul. 10, 1990

[54] TANK FOR A HEAT EXCHANGER

[75] Inventor: Kevin E. Stay, Greenfield, Wis.

[73] Assignee: Modine Manufacturing Company, Racine, Wis.

[21] Appl. No.: 39,473

[22] Filed: Apr. 16, 1987

[51] Int. Cl.[5] ..... F28F 9/02

[52] U.S. Cl. ..... 165/173; 165/149; 165/153; 165/174

[58] Field of Search ..... 165/173, 153, 149, 175, 165/174, 152, DIG. 906

[56] References Cited

U.S. PATENT DOCUMENTS

| | | | |
|---|---|---|---|
| 4,331,201 | 5/1982 | Hesse | 165/153 |
| 4,378,174 | 5/1983 | Hesse | 165/149 |
| 4,423,769 | 1/1984 | Cadars | 165/174 |
| 4,531,578 | 7/1985 | Stay et al. | 165/175 |
| 4,600,051 | 7/1986 | Wehrman | 165/149 |
| 4,678,026 | 7/1987 | Lenz et al. | 165/149 |

FOREIGN PATENT DOCUMENTS

| | | | |
|---|---|---|---|
| 1967053 | 11/1976 | Fed. Rep. of Germany | 165/175 |

*Primary Examiner*—Ira S. Lazarus
*Assistant Examiner*—Sue Hagarman
*Attorney, Agent, or Firm*—Wood, Phillips, Mason, Recktenwald & Van Santen

[57] ABSTRACT

So-called suck-in (FIG. 6) and banana-ing (FIG. 7) in a plastic tank for a vehicular radiator having elongated side walls 102, 104 connected by short end walls 106, 108 and having an opening 112 surrounded by a peripheral flange 114 which in turn includes a planar sealing surface 124 is eliminated by the provision of a substantially continuous, peripheral bead 140 about the tank generally parallel to the flange 114 and in close adjacency thereto.

8 Claims, 2 Drawing Sheets

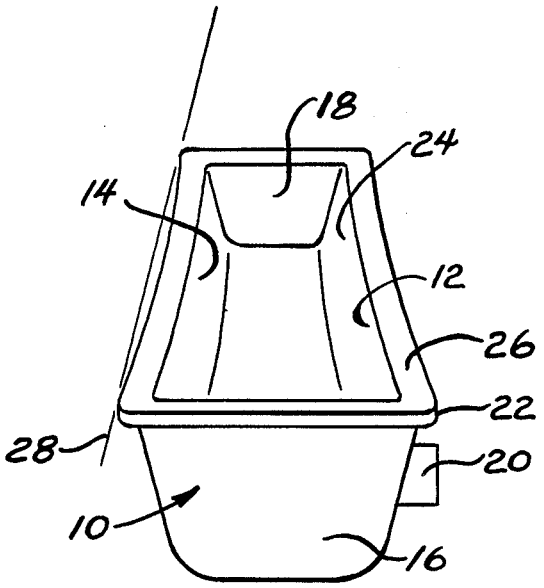
FIG. 6
PRIOR ART
FIG. 7
PRIOR ART
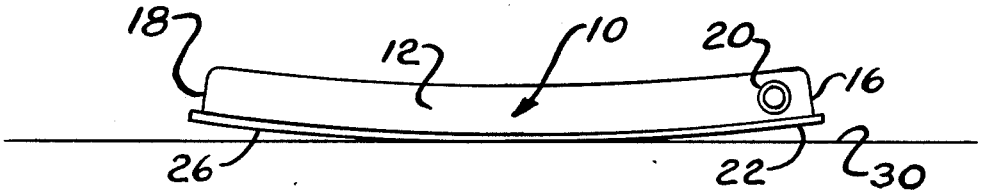

TANK FOR A HEAT EXCHANGER

FIELD OF THE INVENTION

This invention relates to heat exchangers of the type having a header plate supporting the open ends of a plurality of tubes and a plastic tank secured to the header plate; and more specifically, to an improved plastic tank construction for such heat exchangers.

BACKGROUND OF THE INVENTION

The effort by the automotive industry to reduce the weight of vehicles to thereby improve fuel efficiency has seen an increasing use of non-metallic materials in various parts of vehicles. Heat exchangers, more commonly termed radiators, are no exception. While metal materials are still employed in the cores of such heat exchangers because of their greater thermal conductivity over plastics, other heat exchanger components that do not require good thermal conductivity are being made of plastic. A primary example is the so-called tanks which are fitted to the heat exchanger core most typically by securement to the header plates which define the ends of the cores.

In a typical case, the header plate is provided with a peripheral groove and a seal or gasket is disposed in such groove. The plastic tanks include a peripheral flange defining a nominally parallel sealing surface. The tank is fitted to the header plate by locating the flange within the groove with the sealing surface compressing the seal to establish a seal at the header plate-tank interface and a variety of means are utilized to hold the components in assembled relation.

Representative prior art illustrating constructions of this sort include U.S. Pat. Nos. 4,378,174 and 4,331,201 issued respectively May 29, 1983 and May 25, 1982 to Hesse, and commonly assigned U.S. Pat. Nos. 4,531,578 issued July 30, 1985 to Stay et al and 4,600,051 issued July 15, 1986 to Wehrman.

A couple of difficulties attend the use of plastic tanks and these difficulties become aggravated as the size of the tank increases. In particular, and with reference to FIGS. 6 and 7 herein, plastic tanks are subject to two forms of deformation that may hinder assembly of a tank to a header plate in good sealing relation. One form of such deformation is so-called "suck-in" which is illustrated in FIG. 6 and the other form of such deformation is so-called "banana-ing" which is illustrated in somewhat exaggerated form in FIG. 7.

Tanks of this sort are commonly formed by injection molding and the deformations occur as the molten plastic cools and solidifies. As seen in FIG. 6, a prior art plastic tank, generally designated 10, has elongated, spaced parallel walls 12 and 14 interconnected by end walls 16 and 18. The wall 12 may include a fixture 20 for the ingress or egress of coolant and the walls 12, 14, 16 and 18, together with a peripheral flange 22, define an opening 24 in a generally trough-like configuration. About the opening 24, the flange 22 includes a nominally planar, peripheral sealing surface 26.

As can be readily appreciated in FIG. 6, and with reference to a straight line 28 drawn therein, the walls 12 and 14 have bowed substantially inwardly at locations intermediate their ends. This deformation is, as mentioned above, known as "suck-in" and may make it difficult to fit the flange 22 within the seal receiving groove in the header plate. And though not as much of a problem, suck-in may occur in the end walls 16 and 18 as well.

As seen in FIG. 7, the sealing surface 26, which is intended to be planar as indicated by a line 30, may assume a convex configuration as the entire tank 10 tends to curve like a banana, giving rise to the name "banana-ing" for this second type of deformation.

In any event, when the tank 10 such as shown in FIG. 7 is applied to a header, the gasket in the flange receiving groove of the header will be overly compressed near the center of the walls 12 and 14 and be insufficiently compressed, or even not contacted at all, in the area of the end walls 16 and 18, unless the tank 10 itself is substantially stressed during the assembly operation. In one case, a poor or nonexistent seal results and in the other, as a result of thermal and pressure cycling of the radiator when in use, the overly stressed tank and/or gasket may prematurely fail.

The present invention is directed to overcoming one or more of the above problems.

SUMMARY OF THE INVENTION

It is the principal object of the invention to provide a new and improved plastic tank for use in heat exchangers, specifically, vehicular radiators. More specifically, it is an object of the invention to provide such a tank wherein suck-in and banana-ing are minimized or eliminated along with the difficulties associated therewith.

An exemplary embodiment of the invention achieves the foregoing objects in a plastic tank having a elongated trough-like configuration including elongated, spaced generally parallel walls which are subject to suck-in, relatively short, opposed end walls interconnecting the parallel walls and an elongated opening defined by the walls and by a peripheral flange having a planar sealing surface subject to banana-ing. The invention contemplates the improvement wherein the parallel walls, along substantially their entire length and in close adjacency to the flange, each include a bead which is generally parallel to the flange.

In a preferred embodiment, the bead is on the outer surface of the walls.

In a highly preferred embodiment, the bead is substantially peripheral around the entire tank and is located on the end walls as well.

In a highly preferred embodiment, the bead includes two sections which are nominally at right angles to each other. One of the sections resists suck-in of the parallel walls and the other of the sections resist banana-ing of the planar sealing surface. Preferably, one of the sections is generally at right angles to the sealing surface while the other is generally parallel thereto. The same thus define an external step about the entire tank.

The invention contemplates that the surface of the step remote from the sealing surface on the flange be a pressure receiving surface to which pressure may be applied to cause the sealing surface to compress a gasket during an assembly process.

The invention further contemplates the provision, in at least one of the walls, of an enlarged integral fixture intended to provide for the ingress or egress of coolant. In the case of the provision of such a fixture, the bead or step is continuous about the walls except at the location of the fixtures.

Other objects and advantages will become apparent from the following specification taken in connection with the accompanying drawings.

DESCRIPTION OF THE DRAWINGS

FIG. 6 is a perspective view of an inverted tank made according to the prior art and taken at a relatively shallow angle to illustrate so-called "suck-in"; and FIG. 7 is a side elevation, somewhat exaggerated, of a tank made according to the prior art illustrating so-called "banana-ing".

DESCRIPTION OF THE PREFERRED EMBODIMENT

Figure 1:
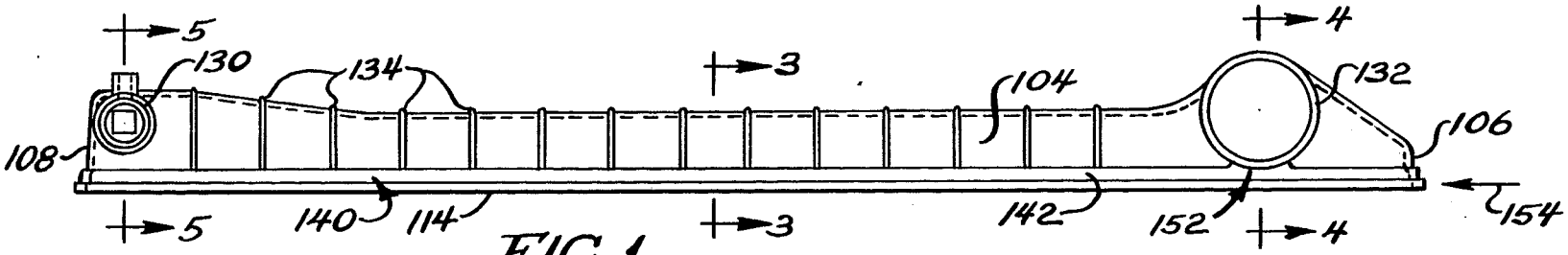
FIG. 1 is a side elevation of a plastic tank made according to the invention.
Figure 2:
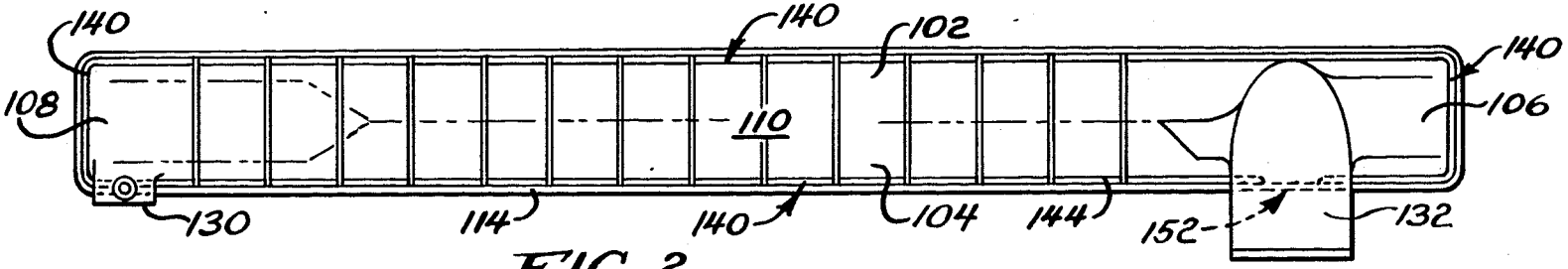
FIG. 2 is a plan view of the tank.
Figure 3:
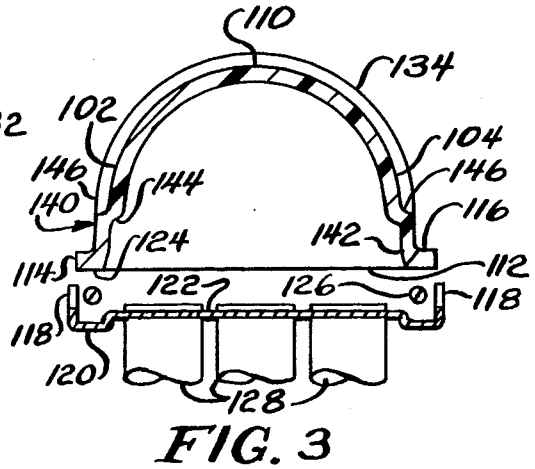
FIG. 3 is a sectional view taken approximately along the line 3—3 in FIG. 1 and additionally showing, in exploded section, a typical header plate with heat exchanger tubes supported thereby as well as a gasket.
Figure 4:
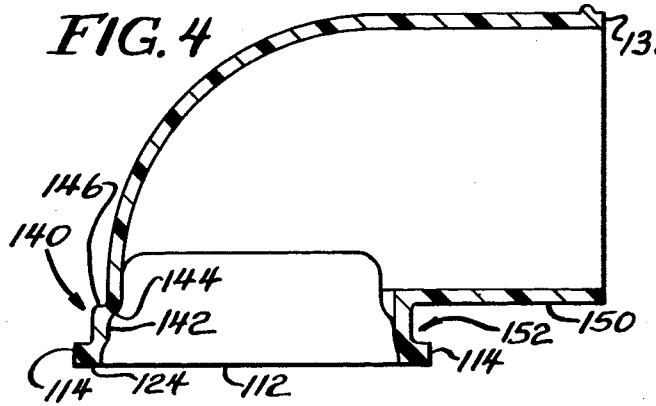
FIG. 4 is a sectional view taken approximately along the line 4—4 in FIG. 1.
Figure 5:
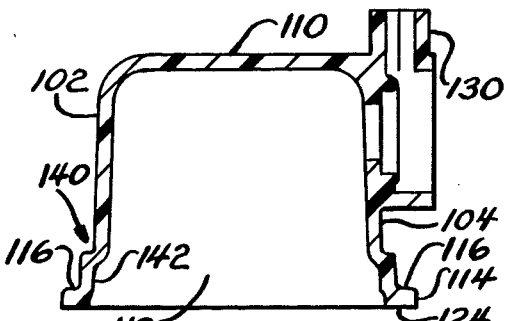
FIG. 5 is a sectional view taken approximately along the line 5—5 in FIG. 1.

An exemplary embodiment of a plastic tank made according to the invention is illustrated in FIGS. 1 and 2. The same includes spaced, elongated side walls 102 and 104 interconnected at their ends by relatively short end walls 106 and 108. On one side, the walls 102, 104, 106 and 108 are connected by a bottom 110. Oppositely of the bottom 110, the tank includes an elongated opening 112 as best seen in FIGS. 3-5, inclusive. Thus, a trough-like construction is defined.

The opening 112 is surrounded by a peripheral flange 114 which projects outwardly and away from the interior of the tank. One side 116 of the flange 114 is adapted to be abutted by any conventional type of retaining structure for holding the tank assembled to a header plate. Various types of structures for the purpose are illustrated in the previously identified patents. FIG. 3 illustrates a series of upstanding fingers 118 on the outer wall of a seal receiving groove 120 in a header plate 122 and which may be bent to overlie the surface 116 when the flange 114 is disposed in the groove 120.

The surface 124 of the flange 114 opposite the surface 116 is a planar sealing surface and with reference to FIG. 3 is adapted to compress a gasket 126 which may be located within the groove 120 for sealing purposes when the tank is mounted to the header plate 122. FIG. 3 also illustrates a series of tubes 128 mounted to the header plate 122 in a conventional fashion.

As seen in FIGS. 1 and 2, the elongated wall 104 includes first and second, integral fixtures 130 and 132 which provide for the ingress or egress of coolant into or out of the tank by connection to hoses or other fittings, vent valves, drains or the like as may be desired. The particular location as well as the provision of one or more of the fixtures forms no part of the present invention as the location, size and number of fixtures will most frequently be determined by the specific application or vehicle in which a radiator including a tank made according to the invention is to be installed.

At various locations along the length of the tank, the same may be provided with integral strengthening ribs 134 which improve the ability of the walls 102 and 104 as well as the bottom 110 to resist internal pressure within the tank during operation of the heat exchanger to which it may be affixed.

Thus far, the tank described may be regarded as conventional. Without more, it would be subject to undesirable suck-in and banana-ing just as prior art devices.

To avoid these problems, in close adjacency to the flange 114, and about substantially the entire exterior periphery of the tank, there is located a bead, generally designated 140. The bead 140 is in the form of a step having a vertical section 142 (FIGS. 3-5) that is nominally at right angles to the plane of the sealing surface 124 and a horizontal section 144 which is normally parallel to the sealing surface 124 and which interconnects the end of the vertical section 142 remote from the surface 124 and the balance of the associated walls 102, 104, 106 and 108. For reasons that are not completely clear, the presence of the vertical section 142 resists the banana-ing type of deformation with the consequence that the sealing surface 124 will be planar or so very nearly so that the difficulties associated with banana-ing during assembly of the tank to a header plate are avoided.

The horizontal section 144 serves to prevent suck-in with the result that the difficulties associated with suck-in during assembly of the tank to a header plate are likewise avoided.

Other, secondary, advantages accrue. The bead 140 acts much like a strengthening rib to provide increased strength which is desirable when the tank is pressurized. In addition, the upper surface 146 of the horizontal section 144, which is on the exterior of the tank, can serve as a pressure receiving surface during assembly. In particular, on opposite sides of the tank, a purely vertical force may be applied along the surface 146 to drive the sealing surface 124 into compressing relation with a gasket 126 in a groove 120 in a header plate 122. Because the pressure receiving surface 146 is almost in a direct vertical line with the sealing surface 124, and because of the proximity of the former to the latter, only a small part of the tank is stressed during assembly, and then in compression. Thus, assembly without undesirable stressing of the tank is facilitated.

It should also be noted that while making the bead 140 continuous peripherally about the tank is desirable, it is not completely necessary. For example, it may be dispensed with in some instances on the end walls 106 and 108 because they are relatively short which in turn means that such suck-in as they may experience represents only a small deviation from the desired configuration. Similarly, the shortness of such walls means that there will be no significant banana-ing across the tank in a direction 90 degrees to the showing in FIG. 7.

Furthermore, in instances where relatively large fixtures such as the fixture 132 are required to be located in one of the walls 102, 104, 106 or 108, spacial requirements may dictate a discontinuity of the bead 140 where a part 150 of the fixture 132 comes in close proximity to the flange 114 as seen in FIG. 4. This area of discontinuity is generally designated 152 in FIGS. 1, 2 and 4.

In general, the tank will be made by injection molding. While a variety of materials can be used, nylon 6-6 filled with 33% glass fiber and sold by DuPont under the trademark ZYTEL FE5105-BK83 may be used with efficacy. In such a case, to maximize the effectiveness of the bead, it is desirable to injection mold the tank with injection of plastic from a single end as indicated by an arrow 154 in FIG. 1. Such injection tends to orient the fibers lengthwise of the tank and that in turn will improve dimensional stability of the resulting tank.

From the foregoing, it will be appreciated that a tank made according to the invention eliminates the difficulties heretofore associated with suck-in and banana-ing. Further, additional bonuses are received in the form of increased resistance to internal pressure and in the provision of a pressure receiving surface that may be advantageously utilized during assembly.

Finally, the step like configuration of the bead 140 and its location on the tank exterior minimizes the complexity of the mold used to form the tank. A review of FIGS. 1–5, inclusive, will clearly show that a tank made according to the invention can be made without resorting to compound molding techniques except as may be required to form fixtures such as those shown at 130 and 132.

What is claimed:

1. In a plastic tank for a vehicular radiator having an elongated trough-like configuration including two elongated, spaced, generally parallel walls subject to "suck-in", relatively short, opposed end walls interconnecting said parallel walls, and an elongated opening defined by said walls and by a peripheral flange having a planar sealing surface subject to "banana-ing", the improvement wherein said walls, in close adjacency to said flange, include a substantially peripheral step.

2. The tank of claim 1 wherein said step includes a generally vertical section extending at a nominal right angle from said sealing surface and a generally horizontal section nominally parallel to said sealing surface extending from said vertical section to the balance of said walls.

3. The tank of claim 2 wherein at least one of said walls includes an integral, enlarged fixture for the ingress or egress of coolant and said step is continuous about said walls except at the location of said fixture(s).

4. In a plastic tank for a vehicular radiator having an elongated trough-like configuration including two elongated, spaced, generally parallel walls subject to "suck-in", relatively short, opposed end walls interconnecting said parallel walls, and an elongated opening defined by said walls and by a peripheral flange having a planar sealing surface subject to "banana-ing", the improvement wherein said parallel walls, along substantially their entire length and in close adjacency to said flange, each include a bead which is generally parallel to said flange.

5. The tank of claim 4 wherein said beads are on the outer surface of said walls.

6. In a plastic tank for a vehicular radiator having an elongated trough-like configuration including two elongated, spaced, generally parallel walls, relatively short, opposed end walls interconnecting said parallel walls, and an elongated opening defined by said walls and by a peripheral flange having a planar sealing surface, the improvement wherein said walls include an external, substantially peripheral bead generally parallel and in close adjacency to said flange.

7. The tank of claim 6 wherein said bead includes two sections which are nominally at right angles to each other, one of said sections resisting "suck-in" of said parallel walls and the other of said sections resisting "banana-ing" of said planar surface.

8. The tank of claim 7 wherein one of said sections further defines an external pressure receiving surface against which pressure may be applied to urge said sealing surface against a seal to compress the same during assembly of said tank to a header for a vehicular radiator.

* * * * *